US008815171B2

(12) United States Patent
Wagner

(10) Patent No.: US 8,815,171 B2
(45) Date of Patent: Aug. 26, 2014

(54) CAST SOLID PRODUCT DISPENSER

(75) Inventor: Christopher C. Wagner, St. Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 145 days.

(21) Appl. No.: 13/228,914

(22) Filed: Sep. 9, 2011

(65) Prior Publication Data

US 2013/0064732 A1 Mar. 14, 2013

(51) Int. Cl.
*B01D 11/04* (2006.01)

(52) U.S. Cl.
USPC ..... 422/255; 422/261; 222/77

(58) Field of Classification Search
USPC ..... 422/261, 255, 266; 222/77
See application file for complete search history.

(56) References Cited

U.S. PATENT DOCUMENTS 2,613,922 A 10/1952 Gatchet
3,332,871 A * 7/1967 Robinson ..... 210/697
4,420,394 A 12/1983 Lewis
4,687,121 A 8/1987 Copeland
4,826,661 A 5/1989 Copeland et al.
5,100,032 A 3/1992 Burdorf et al.
5,505,915 A 4/1996 Copeland et al.
7,250,086 B2 7/2007 Furber et al.
7,410,623 B2 8/2008 Mehus et al.
2011/0293481 A1 * 12/2011 Eanes et al. ..... 422/106

FOREIGN PATENT DOCUMENTS

WO WO 95/09558 A1 4/1995

* cited by examiner

*Primary Examiner* — Sean E Conley
(74) *Attorney, Agent, or Firm* — McKee, Voorhees & Sease

(57) ABSTRACT

A cast solid product dispenser for controlling the inputs and operating parameters of dissolution of a cast solid product is disclosed. The dispenser (10) includes a housing (12) having a cavity (18) for removably receiving a container (14) holding a cast solid product. The dispenser (10) includes means for controlling the temperature and pressure of liquid used for dissolution of the cast solid product. The dispenser (10) also includes a pedestal (20) for maintaining a constant distance between the surface of the product and a nozzle (48) during dissolution. The dissolution cycle includes a pulse of spray generally followed by a delay to allow liquid used in the dissolution process to adjust to a desired temperature. A pressure regulator (42) adjusts the pressure variation between various liquid sources so both the pressure and temperature of liquid used in the dissolution process is generally constant.

20 Claims, 8 Drawing Sheets

CAST SOLID PRODUCT DISPENSER

BACKGROUND OF THE INVENTION

1. Field of the Invention

This invention relates generally to a dispenser for cast solid products and more particularly to a dispenser adapted for controlling the inputs and operating parameters for dissolution of the cast solid product.

2. Description of the Prior Art

Dissolution of cast solid product for obtaining a solution, such as a liquid detergent, for cleaning and sanitizing change based on the inputs and operating parameters of the dissolution process. Changes and fluctuations in the inputs can result in significant change in the chemistry, effectiveness and efficiency of the resulting solution.

It is therefore desirable to provide a dispenser that controls the inputs and operating parameters of dissolution of a cast solid product.

It is further desirable to provide a dispenser that is effective at controlling the operating parameters of the dissolution process independent of the operating environment.

SUMMARY OF THE INVENTION

In one embodiment, the invention is a dispenser for dissolving and dispensing solid product. The dispenser includes a housing having a liquid inlet adapted for connection to a liquid source providing liquid having a source pressure and temperature, and a solution outlet adapted for connection to an end-use appliance. The dispenser also includes a section of the housing adapted for removably receiving a container housing a solid product, such a cast solid detergent. A nozzle is connected in fluid communication with the liquid inlet. The dispenser includes means for maintaining a constant distance of separation between the nozzle and the product in the container for controlling concentration of the solution. In a preferred form, the dispenser also includes a sump having an inlet in solution receiving communication with the nozzle and solid product container, and means for adjusting the temperature of the source liquid to a preferred dissolution temperature.

In another embodiment, the invention is a dispenser for dissolving and dispensing a solid product. The dispenser includes a housing having a liquid inlet adapted for connection to a liquid source and a solution outlet adapted for connection to an end-use appliance. A cavity is included in a section of the housing and is adapted for removably receiving a container housing a solid product. A nozzle is configured within the cavity and is connected in fluid communication with the liquid inlet. A pedestal is removably received within the cavity and has a top and opposite bottom portion. The top portion is positioned above the nozzle and adapted for supporting the solid product within the container. In a preferred form, the bottom portion of the pedestal is positioned below the nozzle and the cavity includes a collector basin connected in fluid communication with a sump. During the dissolution cycle the container iterates downward toward the bottom portion of the pedestal and a constant distance of separation is maintained between the nozzle and product in the container for controlling concentration of the solution.

In another embodiment, the invention is a method for dissolving and dispensing solid product. The method includes providing a dispenser having a housing with a liquid inlet adapted for connection to a liquid source and a solution outlet adapted for connection to an end-use appliance. A container housing a solid product is inserted at least partially into the housing. The solid product in the container is supported while liquid is sprayed from a nozzle onto the solid product thereby maintaining a constant distance of separation between the nozzle and solid product during dissolution as the container iterates toward the nozzle. In a preferred form, the method includes adjusting the temperature of the liquid from the liquid source to a preferred dissolution temperature by passing the liquid through at least one section of tubing having a heat transfer coefficient greater than other sections of tubing, and by controlling a delay time between intermit spraying of the solid product. The method also includes storing solution from the dissolution process in a sump connected in fluid communication with the end use appliance, such as a dump and fill warewashing machine.

DETAILED DESCRIPTION OF THE PREFERRED EMBODIMENTS

Figure 1:
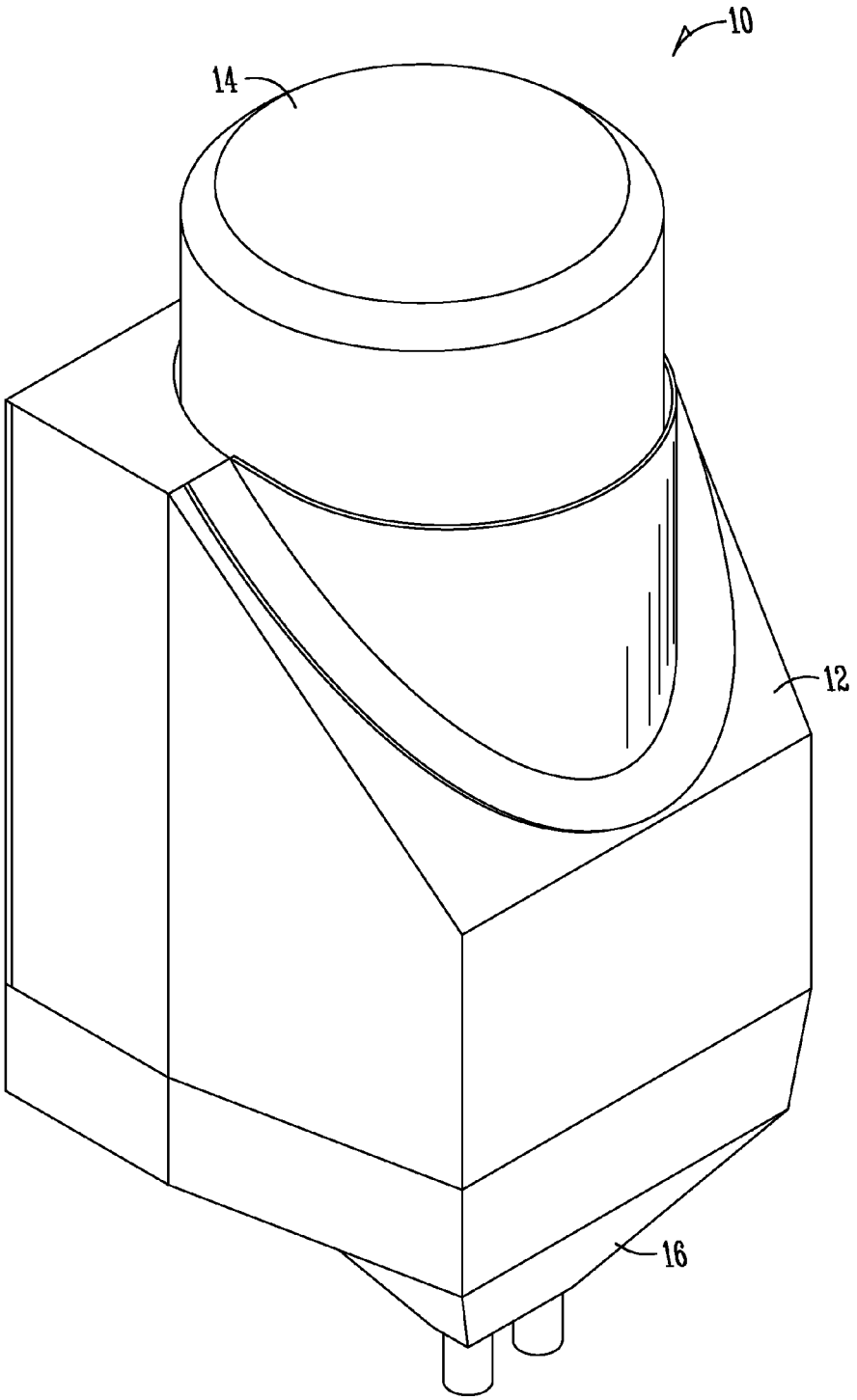
FIG. 1 is an isometric view of an exemplary embodiment of the dispenser of the present invention.
Figure 2:
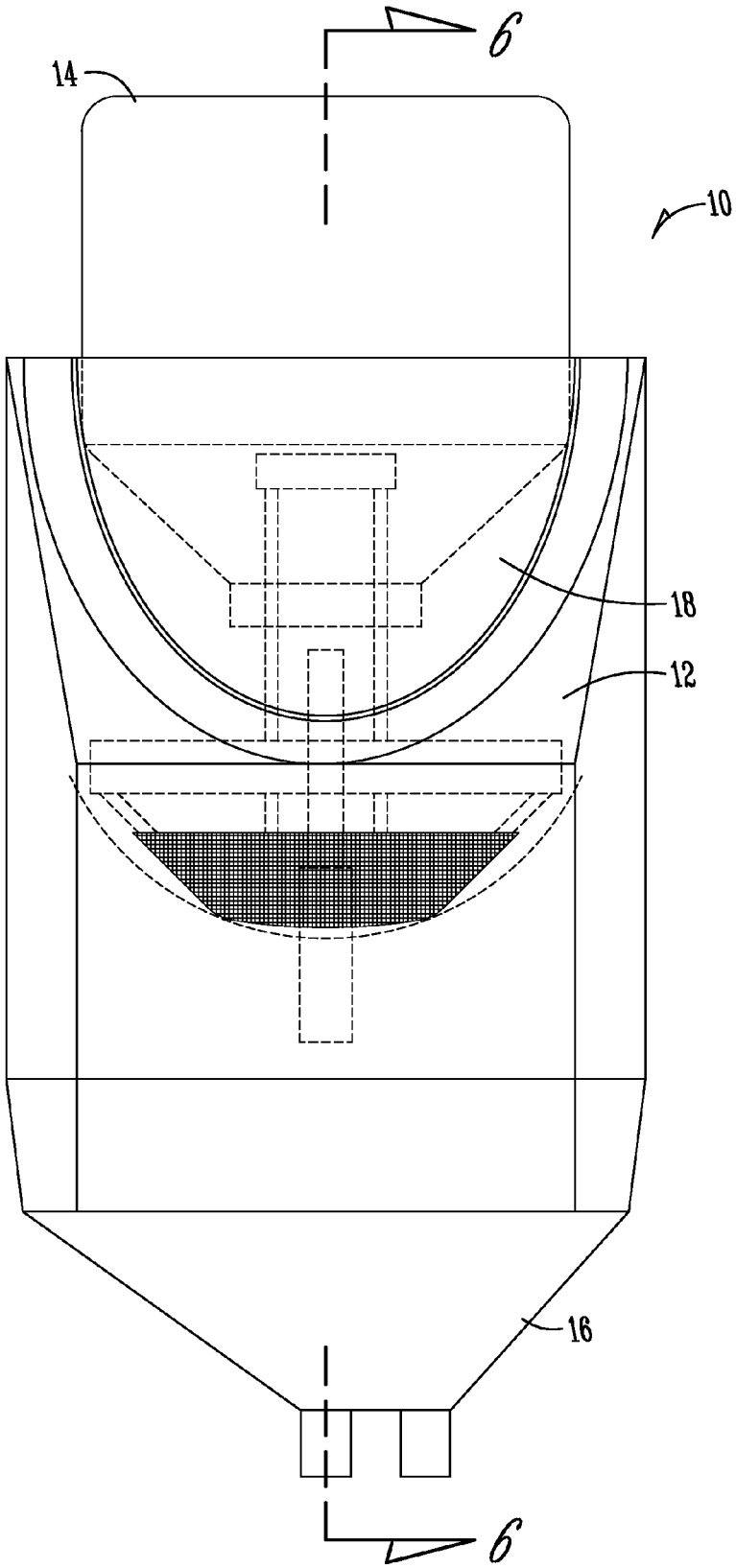
FIG. 2 is a front elevation view of the dispenser shown in FIG. 1.
Figure 3A:
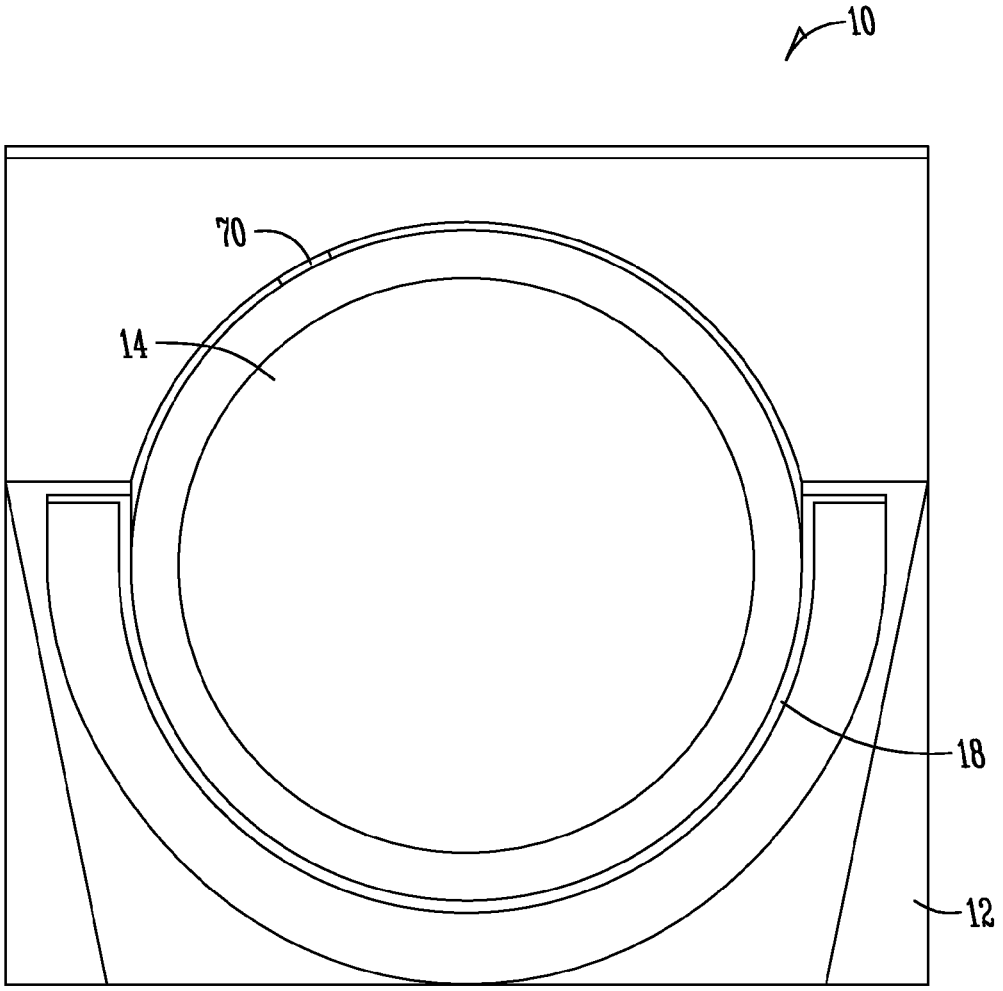
FIG. 3A is a top plan view of the dispenser shown in FIG. 1.
Figure 3B:
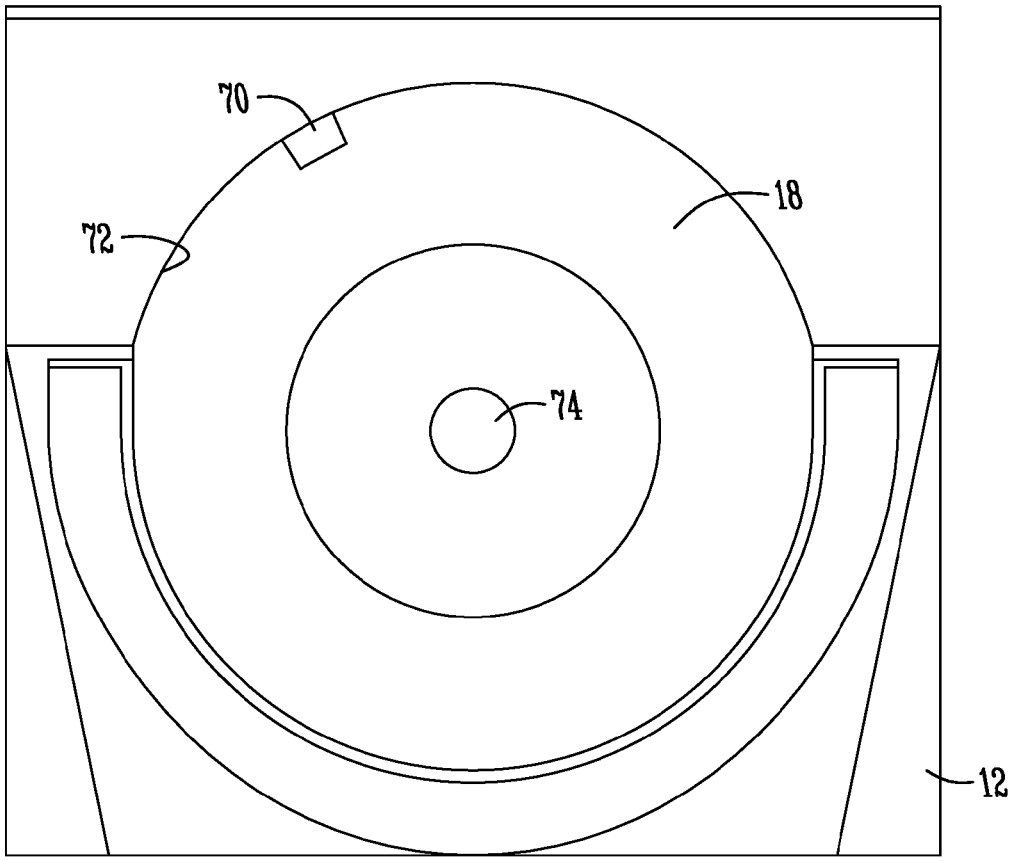
FIG. 3B is another top plan view of the dispenser according to an exemplary embodiment of the present invention.
Figure 6:
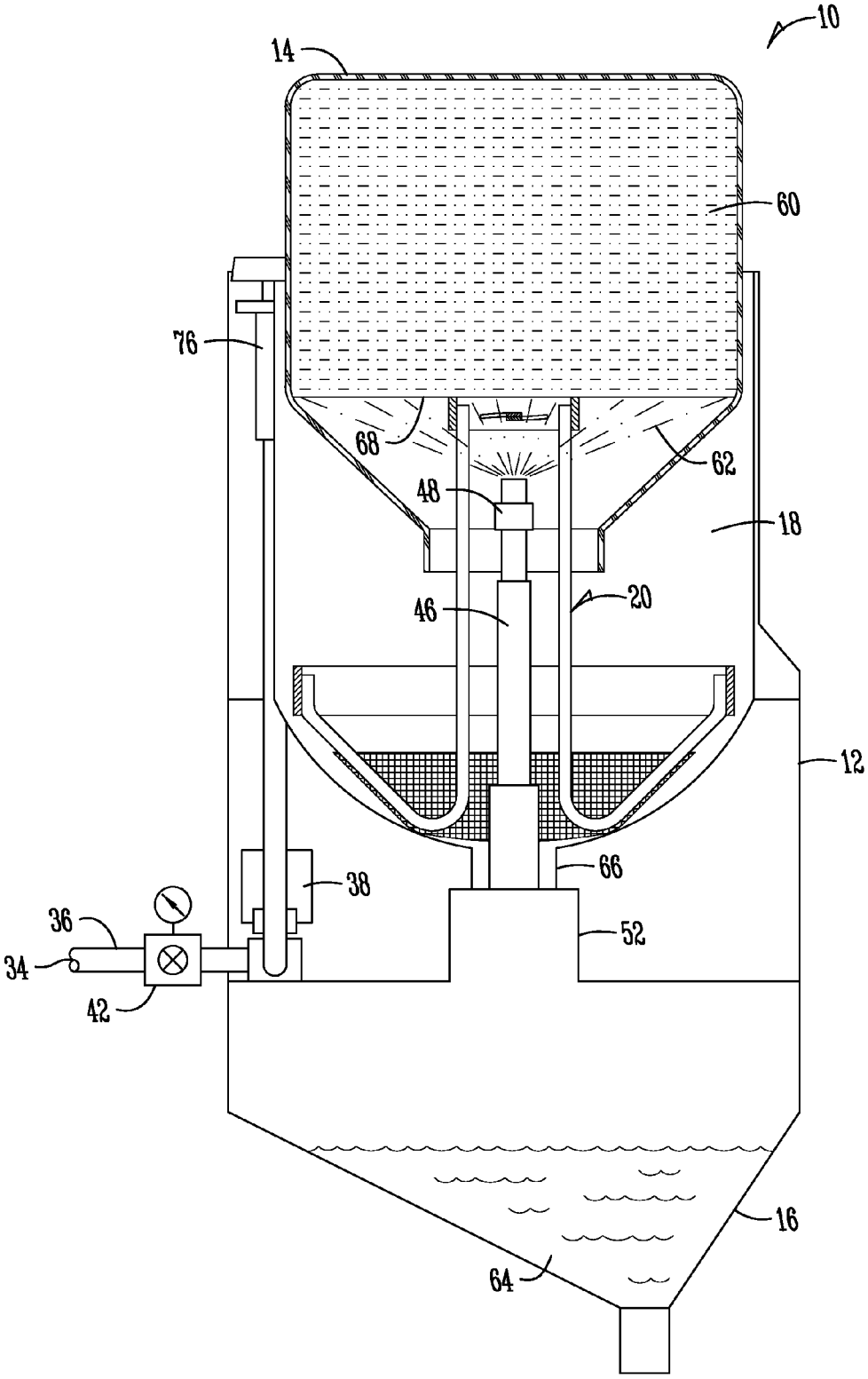
FIG. 6 is a sectional view of the dispenser shown in FIG. 2 taken along line 6-6.
Figure 7:
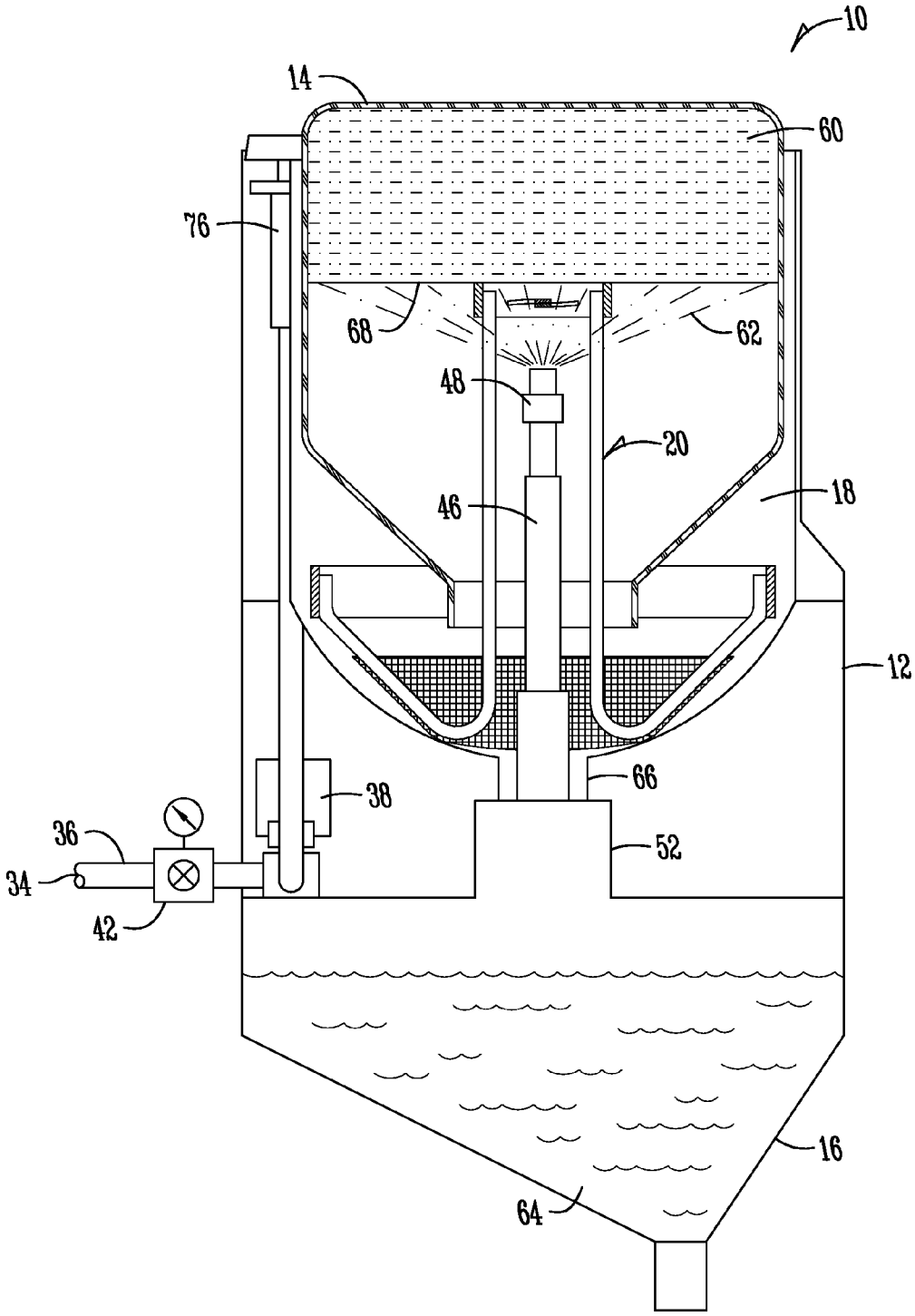
FIG. 7 is another illustration of the dispenser shown in FIG. 5 according to an exemplary embodiment of the present invention.

FIGS. 1-3 illustrate exemplary embodiments of dispenser 10. The dispenser 10 includes a housing 12. The housing 12 generally includes sides separated by front and back surfaces. The dispenser 10 may be mounted within a work environment using one of the sides of the housing 12. The dispenser 10 also includes a sump 16 positioned generally at a lower portion of the housing 12. As illustrated in FIG. 6, the dispenser 10 also includes an inlet 34 of conduit 36 for communicating liquid to the dispenser 10. The inlet 34 of dispenser 10 is connected in fluid communication with a liquid source (not shown) such as a water outlet, water heater or water spigot associated with the working environment where the dispenser 10 is mounted and operating. The dispenser 10 also includes outlets 58 in fluid communication with conduits 56 for communicating a solution 64 (as illustrated in FIGS. 6-7) to be used in a cleaning and/or sanitizing process, such as a warewashing machine. As best illustrated in FIG. 2, the dispenser 10 includes a cavity 18 for removably receiving a container 14. In one form of the present invention, the cavity 18 includes an opening generally on the top side of the dispenser housing 12. The cavity 18 also includes a generally cylindrical side wall 72 as illustrated in FIG. 3B. The contour of the side wall 72 may be changed to accommodate other various geometries for container 14. As shown in FIGS. 6-7, the contour the side wall 72 tapers from generally vertical to an inwardly and downwardly slope toward the opening 74 shown in FIG. 3B. A sensor 70 may be included in the side wall 72 of the cavity 18 for communicating a "container detected" signal to a processor or controller (not shown) when the container 14 is positioned within cavity 18 as illustrated in FIG. 3A and FIGS. 6-7. FIG. 3A shows a top plan view of dispenser 10 with container 14 inserted within the cavity 18 with the opening of the container facing downward as shown in FIGS. 6-7. A feature on the container 14 may correspond with the sensor 70 for indicating to the user how to properly insert container 14 into the cavity 18 of dispenser 10. For example, container 14 may include a groove running generally vertically along the outer peripheral surface of the container which corresponds with the sensor 70 for aligning the container 14 within the cavity 18. As best illustrated in FIGS. 2 and 6-7, the container 14 includes a top having an opening, which is inverted when the container 14 is positioned within cavity 18 of dispenser 10. The container 14 includes product 60, such as a detergent or other chemistry that is preferably in cast solid form. For example, the product 60 may be a concentrated cast solid that is dissolved to obtain a solution, such as a liquid detergent, for use in a cleaning and/or sanitizing process. The product 60 is cast in the container 14 and thereby becomes a solid cast product having a top surface 68 generally near the opening of the container 14.

Figure 4:
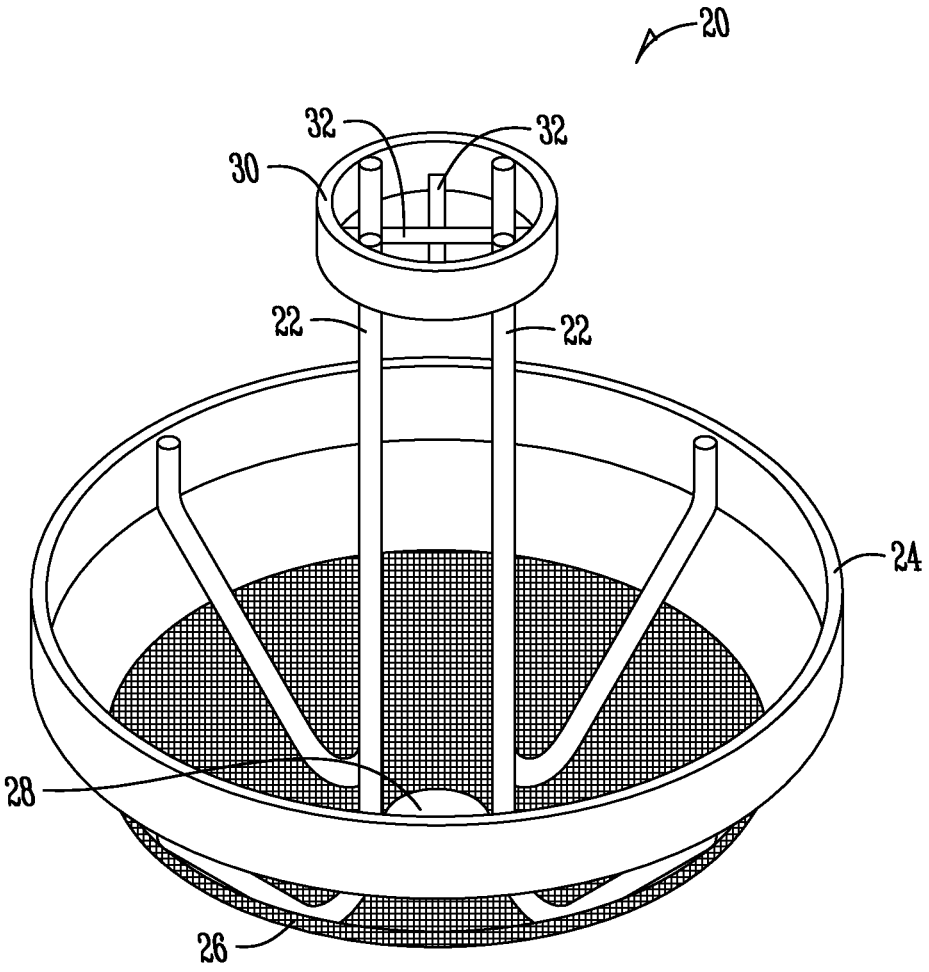
FIG. 4 is an isometric view of a pedestal according to an exemplary embodiment of the present invention.
Figure 5:
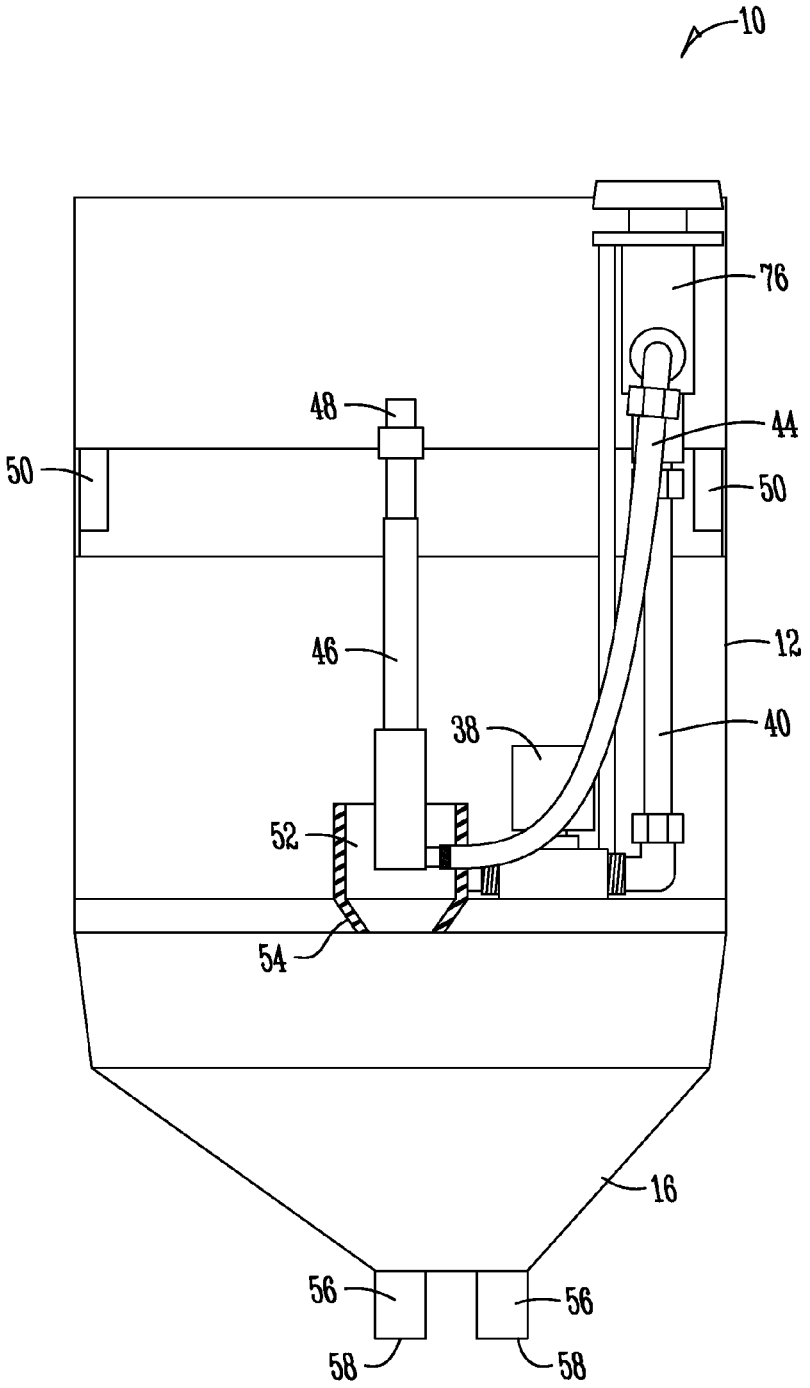
FIG. 5 is a front elevation view of the dispenser in accordance with an exemplary embodiment of the present invention.

The dispenser 10 also includes a pedestal 20 as illustrated in FIG. 4. The pedestal 20 includes generally a plurality of legs 22. Each leg 22 is generally J-shaped and includes upper and opposing lower outer ends. The upper end of each leg 22 is connected to a support ring 30. The support ring 30 includes a pair of cross members 32 attached to counter posing sides of the interior surface of the support ring 30. The opposing outer lower ends of each leg 22 are attached to a base ring 24. A portion of each leg 22 between the outer lower end and upper end is attached to a screen 26. The screen 26 includes an opening 28 centered generally between the legs 22. Each of the legs 22 also includes a generally downwardly and inwardly sloping portion and a generally vertical portion extending upward to the support ring 30. The screen 26 is preferably affixed to the downwardly sloping portion of each leg 22 as illustrated in FIG. 4. As best illustrated in FIGS. 6-7, the pedestal 20 is removably positioned within cavity 18 of dispenser housing 12. At least a portion of the J-shaped legs 22 rests on the inwardly tapered side walls 72 of cavity 18 for stabilizing the pedestal 20. A riser 46 and nozzle 48 are received through the opening 28 in the pedestal 20 when the pedestal 20 is inserted within the cavity 18 as further addressed below. When a container 14 with product 60 is inverted and positioned within cavity 18 as illustrated in FIGS. 6-7, the surface 68 of product 60 within container 14 rests on the support ring 30 of pedestal 20. The legs 22 of pedestal 20 have a sufficient height so as to position the support ring 30 above the height of nozzle 48. The present invention contemplates that the pedestal 20 may include other various geometries for legs 22, and base and support rings 24 and 30. The purpose of the pedestal 20 is to keep the surface 68 of product 60 within container 14 at the same position above nozzle 48 as the product 60 is dissolved and the container 14 iterates downward as best illustrated in FIGS. 6-7. In a preferred form of the present invention, the pedestal 20 includes legs 22 having a shape similar to the outer profile of the top portion of container 14. Thus, as container 14 iterates downward within cavity 18, in its inverted position, the top and opening portion of container 14 are received within the base ring 24 and the downwardly and inwardly sloping portions of legs 22 as shown in FIG. 7.

As indicated previously, dispenser 10 includes an inlet 34 associated with conduit 36. The inlet 34 is connected in fluid communication with a liquid source, such as a heated water source. Conduit 36 connected to inlet 34 is connected in fluid communication with a pressure regulator 42 and valve 38. Valve 38 is connected electronically with a controller or processor for selectively moving the valve 38 between open and closed positions. Conduit 40 is connected in fluid communication with the outlet of valve 38 and the outlet of pressure regulator 42. Pressure regulator 42 adjusts the pressure of the inlet liquid to a desired outlet pressure. For example, the pressure of the liquid source may vary and thus the pressure regulator 42 is adapted to control the pressure of the liquid being communicated to nozzle 48. Conduit 40 is also connected in fluid communication with vacuum breaker 76. Vacuum breaker 76 prevents backflow of liquid from nozzle 48. A conduit 44 is connected in fluid communication with the vacuum breaker 76 and riser 46. The riser 46 extends up a distance vertically and terminates in a nozzle 48 through which liquid is dispensed as a spray 62 as best illustrated in FIGS. 6-7. A collector basin 52 surrounds generally the lower portion of riser 46. The collector basin 52 has generally upstanding walls and a circular cross section and terminates downwardly at an inlet 54 to the sump 16.

In operation, dispenser 10 is mounted within a work environment generally adjacent or in close proximity to a cleaning and/or sanitizing device. In a preferred form of the present invention, outlets 58 of dispenser 10 are connected in fluid communication with one or more warewashing machines, such as a dump and fill type machine. The inlet 34 of dispenser 10 is connected in fluid communication with a liquid source, such as a hot water source. Liquid from the source enters the dispenser 10 via inlet 34 and travels through conduit 36 to pressure regulator 42 and valve 38. The liquid entering the dispenser enters at an input temperature and pressure which are both dependent upon factors outside of the dispenser 10, such as the temperature setting of the hot water heater and the pressure of the domestic water line. Since the pressure and temperature of the liquid entering the dispenser will vary from install location to install location, the dispenser includes means for controlling the inputs to the dispenser 10, such as the temperature and pressure of the liquid entering the dispenser 10. Since variation in the inputs to the dispenser affect the dissolution process, controlling and/or managing these and other inputs allow the dissolution process to be calculated and precise.

For example, in one instance of the present invention, liquid from a hot water source may vary in temperature, or may be at a temperature outside the desirable dissolution temperature for use in the dispenser 10. To ensure that the temperature of the liquid being used for dissolution is the same for each dissolution cycle, the dispenser 10 includes means for adjusting the liquid temperature coming into the dispenser to generally room temperature before use in the dissolution process. For example, in one instance, depending upon the install location of the dispenser and the inputs to the dispenser, the liquid temperature may exceed room temperature. Alternatively, in some instances, the liquid temperature may be less than room temperature, such as if the liquid is received directly from domestic source. To adjust the incoming liquid temperature according to one aspect of the present invention, a thermally conductive conduit or tube is connected between the liquid source and the nozzle 48. The thermally conductive conduit or tube preferably has a high coefficient of heat transfer to allow the liquid in the tubing to adjust to the temperature of the room before being used for the dissolution process. In one instance of the present invention, a section of copper tubing, such as an 8' section of tubing having a ¼" diameter in one example, is connected between the liquid source and the inlet 34 of the dispenser 10. The liquid in the thermally conductive tubing resides in the tubing a sufficient time to adjust to room temperature before being used in the dissolution process within the dispenser 10. The present invention contemplates that other thermally conductive conduit or tubing may be used to allow the liquid in the tubing to adjust to room temperature in a short amount of time. Additionally, fins or other radiating elements, or fins or other radiating elements in combination with forced convection such as a fan may be used in combination with the tubing to allow a shorter section of tubing to be used or a shorter temperature acclimation cycle. In another aspect of the present invention, the tubing may be configured within the housing 12 of dispenser 10 and connected between the inlet 34 and dispenser nozzle 48 for allowing liquid from the liquid source, such as a water heater, to adjust in temperature to the room temperature before being used in the dissolution process. To control the liquid temperature acclimation cycle (i.e., the time the liquid needs to acclimate to generally room temperature), the controller (not shown) communicates open and closed signals to valve 38 for intermittent communication of liquid through nozzle 48. The intermittent opening and closing of valve 38 may include, for example, delays between dispensing sufficient to allow the liquid within the tubing to adjust to room temperature. In one exemplary aspect of the present invention, the valve 38 may be opened for a short pulse, such as for example 0.5 seconds, for dispensing liquid through nozzle 48. The delay time between dispensing could also be controlled so that the liquid within the tubing is given adequate time to adjust to room temperature before being used in the dissolution process. Thus, the temperature of the liquid that is being used in the dissolution process is generally always the same temperature (i.e., room temperature) notwithstanding the source temperature. The time for each pulse and delay between pulses may be adjusted to allow liquid within the tubing to adjust to room temperature before being used in the dissolution process. In one aspect of the present invention, a temperature sensor monitors the temperature of the liquid in the tubing to make sure that it is adjusted to room temperature before being used in the dissolution process. By adjusting the time of each pulse and the delay between pulses, a controller or processor (not shown) can be used to open and close valve 38 so that liquid within the tubing is given sufficient time, depending upon the source temperature, to adjust to room temperature before being used in the dissolution process. When the valve 38 is in the open position, liquid travels through conduit 36 to pressure regulator 42. Since liquid sources between various install locations will likely have different pressures, pressure regulator 42 allows the liquid being used in the dissolution process to have a constant pressure, and to be adjusted to a desired pressure, such as for example 8 psi. The liquid from the pressure regulator 42 is communicated through conduit 40 and 44 and vacuum breaker 76 to riser 46. Riser 46 terminates in a nozzle 48 through which the liquid is dispensed as spray 62, illustrated in FIGS. 6-7.

A key to ensuring that the same amount of product 60 is dissolved during each dissolution cycle is to maintain the same distance between the nozzle 48 and the surface 68 of product 60. This is accomplished using pedestal 20. As product 60 is dissolved during each dissolution cycle, the container 14 iterates downward thereby maintaining the same distance between the nozzle 48 and the surface 68 of product 60 within container 14. In this manner, the same distance is maintained between the surface 68 of product 60 and the nozzle 48, as best illustrated in FIGS. 6-7. Since the liquid being dispensed from nozzle 48 (i.e., spray 62) dispenses at the same temperature, pressure and distance from the surface 68 of product 60, the same amount of product 60 is dissolved during each dissolution cycle with little or no variation. The solution 64 created from the dissolved product 60 and spray 62 from nozzle 48 travels downward, through the opening 74 in the bottom of cavity 18. The sidewall 72 of cavity 18 being tapered inwardly and downwardly toward outlet 66 helps funnel and communicate the solution 64 into the collector basin 52, which is connected in fluid communication with the sump 16 via inlet 54. Thus, as product 60 is dissolved using spray 62 from nozzle 48, the solution 64 travels downward and is collected within the sump 16. Since the temperature of the liquid used for each dissolution cycle is generally constant, the temperature of the solution 64 in the sump 16 is also generally constant. Thus, by controlling the temperature of the liquid used for dissolution the temperature of the solution 64 in sump 16 may also be controlled. In this manner, the generally same temperature solution 64 (e.g., liquid detergent) is delivered to one or more end use applications, such as a dump and fill warewashing machine, via one or more outlets 58. Sump 16 may include a float or another type of level detection system for detecting the level of solution 64 within the sump 16. When a float (not shown) determines that the level of the solution 64 within sump 16 is adequate, a signal may be communicated to a controller (not shown) for terminating the dissolution cycle and closing valve 38. The desired sump 16 fill level may be adjusted depending on the desired volume of solution 64 that is requested by the end use application. The solution 64 in sump 16 is then dispensed to an end use application, such as a dump and fill dish machine, upon request.

Thus, the present invention provides a system for controlling the inputs for achieving dissolution of a cast solid product for obtaining a solution having the same concentration each cycle with little or no variance, which is in turn used by an end use application, such as for use in cleaning and/or sanitizing dishes in a dump and fill type dish machine. Since the temperature and pressure of the liquid providing dissolution of the cast solid product remains constant and the separation distance between the nozzle and the surface where dissolution occurs remains constant, the concentration of the solution 64 remains constant notwithstanding any variations in the install environment or parameters where the dispenser is being used.

The above specification, examples, and data provide a complete description of the manufacturing use of the composition of the invention. Since many embodiments of the invention can be made without departing from the spirit and scope of the invention, the invention resides in the claims hereinafter appended.

What is claimed is:

1. A dispenser for dissolving and dispensing of solid product comprising:

a vertically movable container having a single piece solid product;

a housing having:

a. a liquid inlet adapted for connection to a liquid source providing liquid having a source pressure and temperature, and b. a solution outlet adapted for connection to an end-use appliance;

a section of the housing adapted for removably receiving the vertically movable container housing solid product;

a fixed nozzle connected in fluid communication with the liquid inlet;

a constant distance of separation maintained between the nozzle and product in the container for controlling concentration of the solution; and a sump having an inlet in solution receiving communication with the nozzle and solid product container.

2. The dispenser of claim 1 further comprises means for adjusting the temperature of the source liquid to a preferred dissolution temperature.

3. The dispenser of claim 2 wherein the temperature adjusting means comprises at least one section of conduit having a heat transfer coefficient greater than other sections of conduit.

4. The dispenser of claim 1 further comprises means for adjusting the pressure of the source liquid to a preferred dissolution pressure.

5. The dispenser of claim 1 wherein the section of the housing for receiving the solid product container further comprises a generally vertically oriented cavity having an opening in a top side of the housing.

6. The dispenser of claim 1 further comprising a pedestal having a top and opposite bottom portion, the top portion positioned above the nozzle and adapted for supporting product within the container.

7. The dispenser of claim 2 further comprising a dissolution cycle having at least a pair of pulses of liquid from the nozzle separated by a time delay for adjusting the temperature of liquid from the source temperature to the preferred dissolution temperature.

8. The dispenser of claim 1 wherein the end use appliance comprises a dump and fill warewashing machine.

9. A dispenser for dissolving and dispensing of solid product comprising:

a movable container housing said solid product;

a housing having a liquid inlet adapted for connection to a liquid source and a solution outlet adapted for connection to an end-use appliance;

a cavity in a section of the housing adapted for removably receiving the movable container housing solid product;

a fixed nozzle within the cavity connected in fluid communication with the liquid inlet; and a pedestal extending into the container, the pedestal having a top and opposite bottom portion, the top portion positioned above the nozzle and adapted for supporting product within the container.

10. The dispenser of claim 9 wherein the bottom portion of the pedestal is positioned below the nozzle.

11. The dispenser of claim 9 wherein the cavity further comprises a collector basin connected in fluid communication with a sump.

12. The dispenser of claim 9 further comprises a dissolution cycle wherein the container iterates downward toward the bottom portion of the pedestal.

13. The dispenser of claim 12 wherein a constant distance of separation is maintained between the nozzle and product in the container for controlling concentration of the solution.

14. The dispenser of claim 9 further comprises at least one section of tubing connected in fluid communication with the nozzle, the tube having a heat transfer coefficient of at least 2.0 Btu/($ft^2$*hr*° F.).

15. A dispenser dissolving solid product into a liquid, the dispenser comprising:

a vertically movable container, at least a portion of which is in the cavity, the container housing the solid product;

a housing having:

a liquid inlet;

a cavity;

a fixed nozzle within the cavity in fluid communication with the liquid inlet;

a pedestal extending within the container, the pedestal having a top portion positioned above the fixed nozzle;

a sump located below the cavity; and a solution outlet in fluid communication with the sump.

16. The dispenser of claim 15 wherein the pedestal includes a bottom portion positioned below the nozzle.

17. The dispenser of claim 15 wherein the cavity further comprises a collector basin below the nozzle, the collector basin being in fluid communication with the sump.

18. The dispenser of claim 15 wherein the container iterates downward toward the nozzle as solid product is dissolved.

19. The dispenser of claim 15 further comprising a constant distance of separation between the nozzle and the solid product in the container.

20. The dispenser of claim 15 further comprising at least one section of tubing in fluid communication between the liquid inlet and the nozzle, the tubing having a heat transfer coefficient of at least 2.0 Btu/($ft^2$*hr*° F.).

* * * * *

UNITED STATES PATENT AND TRADEMARK OFFICE

CERTIFICATE OF CORRECTION

PATENT NO. : 8,815,171 B2
APPLICATION NO. : 13/228914
DATED : August 26, 2014
INVENTOR(S) : Christopher C. Wagner It is certified that error appears in the above-identified patent and that said Letters Patent is hereby corrected as shown below:

In the Claims

Col. 6, Claim 1, line 64:
ADD after container "during the dissolution cycle"

Signed and Sealed this
Twenty-seventh Day of January, 2015

Michelle K. Lee

Michelle K. Lee
*Deputy Director of the United States Patent and Trademark Office*